US007905737B2

(12) United States Patent
Byrne

(10) Patent No.: US 7,905,737 B2
(45) Date of Patent: Mar. 15, 2011

(54) CENTER CONNECT SINGLE-SIDED JUNCTION BLOCK

(76) Inventor: Norman R. Byrne, Ada, MI (US)

( * ) Notice: Subject to any disclaimer, the term of this patent is extended or adjusted under 35 U.S.C. 154(b) by 0 days.

(21) Appl. No.: 12/661,734

(22) Filed: Mar. 23, 2010

(65) Prior Publication Data

US 2010/0184316 A1 Jul. 22, 2010

Related U.S. Application Data

(63) Continuation of application No. 11/912,765, filed as application No. PCT/US2006/016733 on May 1, 2006, now abandoned.

(60) Provisional application No. 60/676,655, filed on Apr. 29, 2005.

(51) Int. Cl.
*H01R 4/60* (2006.01)

(52) U.S. Cl. ..... 439/215

(58) Field of Classification Search ..... 439/215, 439/218, 211, 53

See application file for complete search history.

(56) References Cited

U.S. PATENT DOCUMENTS

| | | | | |
|---|---|---|---|---|
| 1,187,010 | A | 6/1916 | Rodrigues | |
| 2,540,575 | A | 2/1951 | Finizie | |
| 4,135,775 | A | 1/1979 | Driscoll | |
| 4,382,648 | A | 5/1983 | Propst | |
| 4,551,577 | A | 11/1985 | Byrne | |
| 4,579,403 | A | 4/1986 | Byrne | |
| 4,959,021 | A | 9/1990 | Byrne | |
| 5,013,252 | A | 5/1991 | Nienhuis et al. | |
| 5,073,120 | A | 12/1991 | Lincoln | |
| 5,096,431 | A | 3/1992 | Byrne | |
| 5,096,434 | A | 3/1992 | Byrne | |
| 5,164,544 | A | 11/1992 | Snodgrass | |
| 5,178,555 | A | 1/1993 | Kilpatrick | |
| 5,252,086 | A * | 10/1993 | Russell et al. | 439/215 |
| 5,259,787 | A | 11/1993 | Byrne | |
| 2008/0254661 | A1 * | 10/2008 | Byrne | 439/215 |
| 2008/0280475 | A1 * | 11/2008 | Byrne | 439/284 |

* cited by examiner

*Primary Examiner* — T C Patel
*Assistant Examiner* — Phuongchi T Nguyen
(74) *Attorney, Agent, or Firm* — Varnum LLP

(57) ABSTRACT

A junction block assembly (300) includes a junction block (302). The junction block (302) is single-sided in that it provides for interconnection of electrical receptacle blocks (310, 308) only on one side of the junction block (302). The junction block assembly (300) includes a first center connect cable assembly (304) and a second center connect cable assembly (306). The center connect cable assemblies (304, 306) are adapted to electrically interconnect to the junction block (302), in a manner so that electrical power received from one of the cable assemblies (304, 306) may be applied to the electrical receptacle blocks (310, 308) connected to the junction block (302), and also to apply power to the other of the center connect cable assemblies (304, 306).

9 Claims, 9 Drawing Sheets

CENTER CONNECT SINGLE-SIDED JUNCTION BLOCK

CROSS-REFERENCE TO RELATED APPLICATIONS

This application is a continuation of U.S. patent application Ser. No. 11/912,765 filed Oct. 26, 2007, which is a national stage application of International Patent Application Serial No. PCT/US06/16733 filed May 1, 2006, which claims priority of U.S. Provisional Patent Application Ser. No. 60/676,655, filed Apr. 29, 2005.

STATEMENT REGARDING FEDERALLY SPONSORED RESEARCH OR DEVELOPMENT

Not applicable.

REFERENCE TO MICROFISHE APPENDIX

Not applicable.

BACKGROUND OF THE INVENTION

1. Field of the Invention

The invention relates to electrical power and communications distribution systems and, more particularly, to systems adapted for use in distributing electrical power and communications within modular wall panels or the like.

2. Background Art

Known interior wall systems typically employ pre-fabricated modular units. These units are often joined together in various configurations, so as to divide a workplace into smaller offices or work areas. Generally, such modular wall panels may be equipped with means for receiving general building power and, possibly, general communications. Such building power may, for example, be conventional AC power received either under floor or from relatively permanent walls or the like. In various types of environments comprising electrical equipment, or wherein electrical apparatus are otherwise employed, interconnections of electrical components to incoming utility power are typically provided by means of cables or wires. For example, in office systems compromising modular furniture components, it is often necessary to provide electrical interconnections between incoming power supplies and various types of electrical devices typically used in an office environment, such as electric typewriters, lamps, etc. Computer-related devices, such as video display terminals and similar peripherals, are also now commonly employed in various office and industrial environments.

One advantage inherent in modular office systems is the capability to rearrange furniture components as necessitated by changes in space requirements, resulting from changes in the number of personnel and other business-related considerations. However, these modular systems must not only allow for change in furniture configurations, but also must provide for convenient interconnection of electrical devices to utility power, regardless of the special configuration of the modular systems and resultant variable distances between electrical devices.

In providing the interconnection of electrical apparatus and power inputs, it is necessary to include an arrangement for feeding the incoming utility power to the power outlets. In stationary structures, such as conventional industrial buildings and the like, a substantial amount of room would normally exist behind stationary walls and other areas in which to provide the requisite cabling for interconnecting incoming utility power to electrical receptacles mounted in the walls. Such systems, however, can be designed so as to remain stationary throughout their lifetime, without requiring general changes in the office or industrial environment areas.

In addition to receiving electrical power from the general incoming building power supply, modular office systems typically require communications connections for office equipment such as telephones, internet communications and the like. The problems associated with providing distribution of communications essentially correspond to the same problems existing with respect to distribution of conventional electrical power.

In this regard, it is known to provide modular wall panels with areas characterized as raceways. Often, these raceways are located along bottom edges of modular panels. The raceways are adapted to house electrical cabling and electrical junction blocks. The cabling and junction blocks are utilized to provide electrical outlets and electrical power connections to adjacent panels. However, it is also apparent that to the extent reference is made herein to providing electrical outlets and electrical power connections for adjacent panels, the same issues exist with respect to providing communications among panels.

Still further, it is known that the raceway of one modular wall unit may be provided with a male connector at one end, and a female connector at another end. Pairs of junction blocks, each provided with electrical outlets, made to be disposed at spaced-apart positions along the raceway. Conduits may be extended between the junction blocks and between the connectors in the junction blocks. In this manner, electrical interconnection is provided between the units.

The modular panels of a space-divider may be configured, such that adjacent panels are in a straight line, or at various angular positions relative to each other. It is common to configure intersecting walls in such a fashion that three or four modular wall panels may intersect at right angles. Each of the panels typically requires electrical outlets, and may require outlets on both sides of the panels. In any event, electrical power has to be provided to all of the panels, and often only one of the panels at the multiple panel junction is connected to a power supply source. Under such circumstances, the interconnecting wiring becomes a significant problem. That is, special modifications may have to be made to power systems of wall panels to be used in such a configuration. Because interchangeability of wall panels is highly desirable, custom modifications are preferably avoided. Still further, modifications of wall panels on site at the installation facility is complex and may be relatively expensive.

In addition to the foregoing issues, problems can arise with respect to the use of junction blocks and the amount of room which may exist within a raceway. That is, raceways require sufficient room so as to provide for junction blocks, electrical outlet receptacle blocks, and cabling extending between junction blocks and between adjacent panels.

One example of a prior art system is illustrated in Propst's, et al., U.S. Pat. No. 4,382,648 issued May 10, 1983. In the Propst, et al. system, mating connectors of opposing panels are engaged when the panels are aligned in a straight line. When the panels are positioned in an intersecting relationship, specially manufactured couplers are utilized. One type of special coupler is used when the panels are positioned at right angles. Another type is used with adjoining panels arranged at angles other than right angles. Consequently, costly inventory of couplers must be maintained. The Propst, et al. system uses a double set of connectors comprising a male and female connector for each conductor to be interconnected. When a single one of these prior art panels intersects two adjacent panels, one of the specially manufactured couplers connects the female terminals to one of the adjacent panels, and another of the couplers connects the male terminals to the adjacent panel.

A further system is disclosed in Driscoll, U.S. Pat. No. 4,135,775, issued Jan. 23, 1979. In the Driscoll system, each panel is provided with an electrical outlet box in its raceway. Panels of different widths are provided with a pair of female connectors. Outlet boxes of adjacent panels are interconnected by means of flexible cables having male connectors at both ends. When three or four panels are adjoined in an intersecting arrangement, two cables may be connected the pair of female connectors at one end of an outlet box. In this manner, connection of two adjacent panels is facilitated.

With respect to both of the foregoing systems, and other than in the special intersecting relationship, one half of the double set of terminals of these systems is superfluous. There is a distinct disadvantage in modern day systems, where several independent electrical circuits are needed in a wall panel system, with each requiring separate connectors. Space for such circuits and their connectors is very limited in the raceway areas of modern, thin-line wall panels.

Other systems also exist with respect to electrical connectors, junction boxes, and the like. For example, Rodrigues, U.S. Pat. No. 1,187,010 issued Jun. 13, 1916, discloses a detachable and interchangeable electrical switch plug adapted for use in connection with various electrically heated appliances. A clamping device is positioned in a fixed, but detachable relationship to one end of the plug. Means are provided to enclose and prevent sharp flexure of the cord comprising a flexible enclosing tube gripped under tension by the other end of the clamping device. The plug and the clamping device may be simultaneously removed from the socket.

Finizie, U.S. Pat. No. 2,540,575, issued Feb. 6, 1951, discloses a cord guide member for utensil plugs. The concept is to reduce wear on the cord and the connector plug, and to provide a connection which will withstand heavy pulling strains without injury. Strain relief is also provided. A sectional body is equipped anteriorally adjacent one end of the body with terminals. The other end of the body contains an anterior chamber or socket. A pivotable cord-guiding member having a pivot member is movably mounted in the socket. A wedge-shaped strain relief insert is received within a wedge-shaped recess in the pivot member. A cord extends into the pivot member and includes wires passing from the cord toward the terminals. The incoming portions of the wires are moved around the insert and firmly wedged within the recess.

Byrne, U.S. Pat. No. 4,551,577, issued Nov. 5, 1985, describes a retractable power center. The power center provides for conveniently located electrical power source receptacles adapted to be mounted on a work surface. In one embodiment, the power center includes a rectangular housing received within a slot in a work surface. A clamping arrangement is utilized to secure the housing to the work surface. A lower extrusion is connected to the lower portion of the housing. A movable power carriage mounts the receptacles and a catch assembly releasably maintains a carriage in a closed and retracted position. In response to manual activation, the catch assembly is released and springs tensioned between the carriage and the extrusion exert forces so as to extend the carriage upward into an extended, open position. In the open position, the user can energize the desired electrical devices from the receptacles, and then lower the carriage into the retracted position.

Byrne, U.S. Pat. No. 4,959,021, issued Sep. 25, 1990, discloses a pivotable power feed connector having a pivotal connector adapted to be connected to a flexible conduit or cable. The cable has a series of conductors extending there through. The connector is pivotably connected to a block assembly through which the conductors extend. The block assembly, in turn, is connectable to a contact block, with the conductors conductively connected to a set of prong terminals extending outwardly from the block. A cover is secured over the block so as to prevent the prong terminals from being exposed during assembly and disassembly.

The cover automatically exposes the prong terminals as the power feed connector is moved into engagement with a receptacle in a modular office panel. The connector allows the conduit or cable to be swiveled to an arc of approximately 180 degrees to any desired position. The connector is also manually removable from interconnection with the block assembly. Such removal allows the conduit or cable to be pulled back from the conductors and cut to a desired length. The connector includes a power feed cover which can be utilized in part to maintain the connector in either of two spatial configurations relative to the block assembly.

Nienhuis, et al., U.S. Pat. No. 5,013,252, issued May 7, 1991, discloses an electrified wall panel system having a power distribution server located within a wall panel unit. The server includes four receptacle module ports oriented in an h-shaped configuration. A first receptacle port is located on the first side of the wall panel unit and opens toward a first end of the unit. A second receptacle unit is also located on the first side of the wall panel unit, and opens toward a second end of the wall panel unit. A third receptacle port and a second sided wall panel unit opens toward the first end of the wall panel unit, while correspondingly, a fourth receptacle port on the second side of the wall panel unit opens toward the second end of the wall panel unit. First and second harnesses are each electrically connected at first ends thereof to the power distribution server. They extend to opposite ends of the wall paneled unit and include connector ports on the second ends thereof for providing electrical interconnection of adjacent wall panel units. The Nienhuis, et al. patent also discloses a system with a wall panel connector interchangeably usable with the interconnection of two, three or four units. The connector includes a hook member for connecting together adjacent vertical members of frames of adjacent wall panel units at a lower portion thereof. A draw naught for connecting together adjacent vertical members of frames of adjacent wall panel units and an odd proportion thereof is provided by vertical displacement thereof.

Lincoln, et al., U.S. Pat. No. 5,073,120, issued Dec. 17, 1991, discloses a power distribution assembly having a bussing distribution connector. The connector includes a series of bus terminals positioned within an electrically insulative housing. A series of electrical terminals are positioned in the housing for distributing more than one electrical circuit. At least one ground terminal, one neutral terminal, and three hot terminals are provided. A grounding shell partially surrounds the bus connector and includes a grounding tab grounding the one ground terminal to the metallic grounding shell. In another embodiment, two bus connectors are interconnected together, so as to provide for an increased number of output ports.

Byrne, U.S. Pat. No. 5,096,431, issued Mar. 17, 1992, discloses an outlet receptacle with rearrangeable terminals. The receptacle is provided with input terminals to selected positions, for engagement with terminals of an electrical junction block. The block includes a series of terminals representing a plurality of different electrical circuits. The receptacle block has neutral, ground and positive flexible positive conductor bars electrically connected to neutral, ground and positive electrical terminals. Input terminals of the block are formed integral with the flexible conductor bars and levers are provided for moving the terminal ends of the conductor bars to physically different positions. In one configuration, the receptacle block housing is provided with openings at opposing ends, and the flexible conductor bars have terminal ends controlled by levers at both ends of the outlet receptacle block. In another configuration, the block has output terminals in a front wall, and the input terminals of the receptacle block are formed as ends of the flexible bars and extend at an approximately 90 degree angle to the bars. They further send through openings in the back wall of the outlet receptacle for engagement with terminals of a junction block. Levers are provided in the back wall of the receptacle block for positioning the terminal ends in alignment with different terminals of the junction block, and windowed openings in the front wall expose indices on the levers identifying selected circuits.

Byrne, U.S. Pat. No. 5,096,434, issued Mar. 17, 1992, discloses an electrical interconnection assembly for use in wall panels of a space divider wall system. The system includes junction blocks having several receptacle connectors, so as to provide a plurality of electrical outlets on both sides of a wall panel. The junction block is connected by means of conduits extending from both ends of the junction block to oppositely directed connector blocks for connection to adjoining panels. The assembly of the junction block and connector blocks allows electrical power to be supplied to one end of the panel and conducted to and through the junction block to other panels. The receptacle connectors on the junction block each have one type of terminal configuration, e.g., a female electrical terminal configuration. One of the connector blocks is provided with the identical terminal configuration. The other connector block is provided with a matching terminal configuration, e.g., a male electrical terminal configuration. When two wall panels are joined at their respective edges, the male connector block may be readily connected to the female connector block in the adjacent panel. When two panels are joined to a third panel, all at one point, the arrangement of this invention allows the male connector block to be connected to the female connector block of one of the other two panels, and the male connector of the other of the two panels may be connected to one of the receptacle connectors of the junction block on either of the other two panels, in this manner establishing a three way interconnection arrangement. In a similar fashion, a fourth, or other additional panels may be added to the junction and plug into receptacle outlets of other panels in order to provide an arrangement of panels that is totally interconnected, electrically.

Snodgrass, et al., U.S. Pat. No. 5,164,544, issued Nov. 17, 1992, describes an electrified space dividing panel having a panel member, raceway, modular, or electric system disposed in a raceway and raceway covers for gaining access to the system. The system includes a single terminal block having end and side sockets, with first and second electrical receptacles being respectively removeably engaged with the end socket and the side sockets, such that the first and second electrical receptacles are disposed in horizontally spaced, side-by-side relation and project outwardly for predetermined light dimensions through receptacle openings in one of the raceway covers. The raceway can include a web having an opening which cooperates with a support ear on the first receptacle during engagement of the first receptacle with an end socket, so as to provide additional lateral support for the electrical receptacle when a plug is removed there from.

Kilpatrick, et al., U.S. Pat. No. 5,178,555, discloses a kit which includes a junction box for installation along a raceway. The kit includes a mounting bracket having a first adjustable mounting mechanism for locating the bracket along the raceway. This provides an initial adjustment, and a second adjustable mounting mechanism is provided for securing the junction box to the mounting bracket. This adjustably locates the junction box along the mounting bracket, and provides a second or final adjustment to accurately locate the junction box between two pre-measured lengths of cable.

Byrne, U.S. Pat. No. 5,259,787, issued Nov. 9, 1993, discloses an electrical junction block mounting assembly, which may be utilized for mounting the junction block within a raceway. The assembly includes a cantilever beam formed on an outer wall of the junction block. This beam is provided with a transversely extending channel for engagement with a support structure. The beam is attached to the junction block by means of a resilient hinge section, and is provided with a first arm section extending between the hinge section and the channel, and a second arm section extending beyond the channel. The first arm section has a sloping surface sloping away from the outer channel between the hinge section of the panel. The second armed section has a sloping surface sloping toward the wall beyond the channel. The surfaces will contact a mounting rail or similar structure during installation of the junction block. In this manner, the hinged cantilever beam is deflected until the rail is in alignment with the channel for engagement with the structural support member.

SUMMARY OF THE INVENTION

In accordance with the invention, a junction block assembly is adapted for use within a raceway of a wall panel for distribution of power through the raceway and through electrical devices external of the raceway. The junction block assembly includes a junction block having a single-sided configuration. That is, the junction block provides for interconnection of receptacle blocks only on one side of the junction block. The assembly also includes a first center connect cable assembly adapted to electrically interconnect to the junction block. Correspondingly, a second center connect cable assembly is also provided and adapted to electrically connect to the junction block. Still further, the assembly includes a first electrical receptacle block which is releasably interconnected to the junction block, and electrically interconnected to the cable assemblies. A second electrical receptacle block is also releasably connected to the junction block and electrically interconnected to the cable assemblies. The first center connect cable assembly and the second center connect cable assembly are physically and electrically connected to the junction block at positions which are located substantially centrally of the elongated length of the junction block.

In accordance with another aspect of the invention, the cable assemblies are adapted to electrically interconnect to the junction block in a manner so that electrical power received from the first center connect cable assembly is applied to both electrical receptacle blocks and to the second center connect cable assembly. In accordance with further aspects of the invention, the junction block includes a housing and a pair of recessed areas comprising a first recessed area and a second recessed area formed within the housing. Each of the recessed areas is adapted to mechanically and electrically receive the electrical receptacle blocks. Still further, each of the recessed areas is formed by a lower wall, an upper wall, a back wall, an outer side wall and an inner side wall. Within the first recessed area, a first electrical connector set extends laterally from the inner side wall. Within the second recessed area, a second electrical connector set extends laterally from the inner side wall of the second recessed area.

In accordance with further aspects of the invention, each of the electrical connector sets is formed by a series of female connectors. Still further, each of the electrical connector sets can comprise an eight wire system. Also, the junction block assembly can include a pair of center position connector sets, comprising a first center position connector set and a second center position connector set. Each of the first center position connector set and second position connector set is electrically connected to one another and to the first electrical connector set extending laterally from the inner side wall of the first recessed area, and to the second electrical connector set extending laterally from the inner side wall of the second recessed area.

In accordance with further aspects of the invention, the junction block assembly can include a pair of junction blocks comprising first and second junction blocks. Each of the junction blocks has a single-sided configuration, in that each of the junction blocks provides for interconnection of electrical receptacle blocks only on one side of each of the junction blocks. A first center connect cable assembly is adapted to electrically interconnect to the first junction block. A second center connect cable assembly is adapted to electrically interconnect to the second junction block.

Further, a first electrical receptacle block is releasably interconnected to the first junction block and electrically interconnected to the first cable assembly. A second electrical receptacle block is releasably interconnected to the second junction block and electrically interconnected to the second cable assembly. The first center connect cable assembly and the second center connect cable assembly are physically and electrically connected to the first junction block and to the second junction block, respectively, at positions which are located substantially centrally of the elongated lengths of the junction blocks.

In addition, positioned at the back of the first junction block is a pair of first center position electrical connector sets. Positioned at the back of the second junction block is a pair of second center position electrical connector sets. Each connector set of the pair of first center position connector sets includes a side flange extending to a side of connectors of the center position connector sets, with the side flange being provided with upper and lower recessed areas adapted to assist in providing engagement with flanges of the first center connect cable assembly. The side flanges are also provided with outwardly extending inclined end surfaces, with the side flanges being deflected inwardly when the end surfaces are engaged by flanges associated with the cable assemblies. In this manner, a locking engagement of the corresponding one of the center position connector sets and the center connect cable assemblies is provided.

In accordance with further aspects of the invention, the junction block assembly can include a pair of junction blocks, comprising first and second junction blocks. Each of the junction blocks can include means for releasably coupling the junction block assembly to an upper wall of the raceway.

BRIEF DESCRIPTION OF THE DRAWINGS

The invention will now be described with reference to the drawings, in which:

FIG. 13 is a perspective and partially exploded view of two single-sided junction blocks in accordance with the invention, and showing an arrangement for interconnection to a raceway or the like.

DESCRIPTION OF THE PREFERRED EMBODIMENT

The principles of the invention are disclosed, by way of example, in a center connecting single junction block assembly 300 as illustrated in FIGS. 8-14. The junction block assembly 300 advantageously provides the capability of interconnecting a junction block assembly having two receptacle blocks to other components within a raceway of a wall panel, with the interconnection of the junction block assembly to other components being achieved through an electrical connection which will essentially be located centrally within the elongated length of the raceway. This provides a significant advantage when sizes and relative relationships of the various components of for example, a panel system, requires electrical cable interconnections along the center of the raceway, rather than adjacent opposing sides of the raceway.

For purposes of describing a configuration where a junction block assembly in accordance with the invention may be utilized, the following paragraphs described a prior art electrical interconnection assembly which was adapted for use within wall panels of a space divider wall system. The interconnection or junction assembly shown in these prior art drawings of FIGS. 1-8 describe and depict a junction block with several receptacle connectors, so as to provide a series of electrical outlets on both sides of the wall panel. The junction block is connected by means of conduits extending from both ends of the junction block to oppositely directed connector blocks for connection to adjoining panels. This assembly of junction block and connector block allows electrical power to be supplied to one end of the panel and conducted to and through the junction block to other junction blocks in the same or other panels. Again, the interconnection and junction assembly shown in FIGS. 1-8 represent a prior art assembly.

Figure 1:
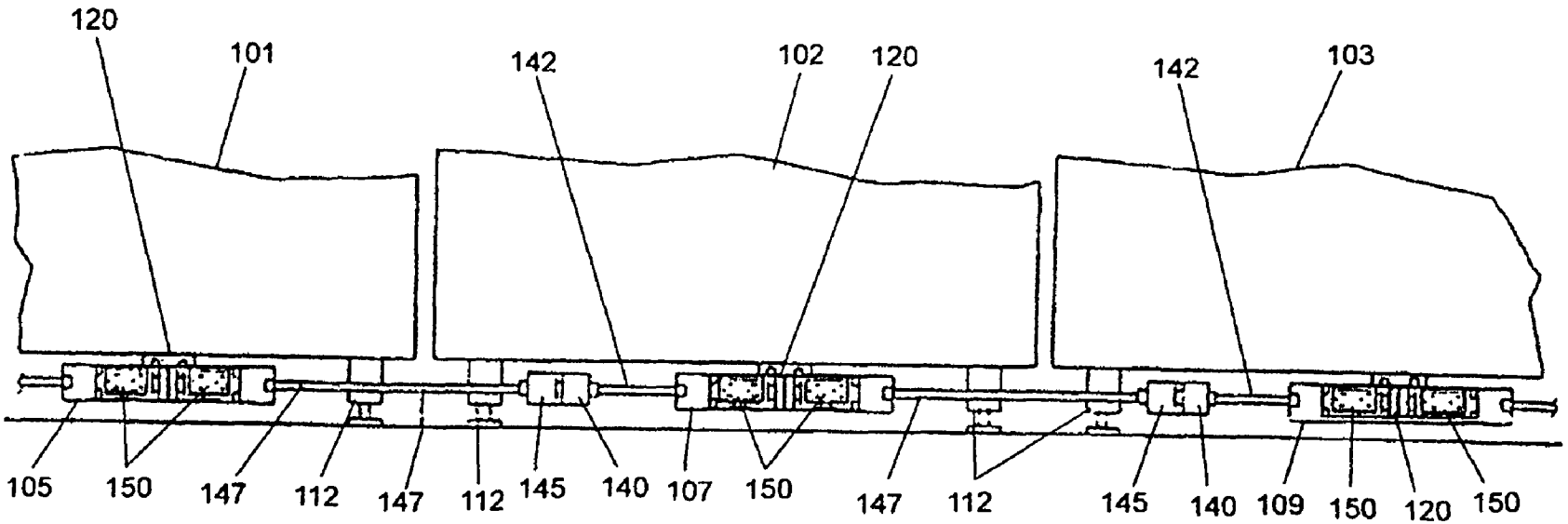
Fig. 1 (Prior Art)
FIG. 1 is a prior art, fragmentary elevation view of a plurality of adjacent wall panels and electrical connection assemblies arranged in the panels.

FIG. 1 is a fragmentary elevational view of adjacent modular wall panels 101, 102, 103 of a rearrangeable wall system. The wall panels are provided with electrical interconnection assemblies 105, 107 and 109 in a raceway area formed along the lower edge of panels 101, 102 and 103. Each of the panels is provided with substantially flat support legs 112 which allow for passage of electrical conduits in the raceway. Raceway covers, customarily used, have been omitted from the drawing in FIG. 1 to better show the electrical junction assemblies. Each of the electrical interconnection assemblies 105, 107, and 109 is provided with a junction block 120, a female electrical connector block 140 and a matching male connector block 145. The connector blocks 140, 145 are connected to associated junction blocks 120 by means of conduit sections 142 and 147, respectively. Each of the junction blocks 120 is shown in FIG. 1 to be provided with a pair of electrical outlet receptacles 150. Junction blocks 120 are double sided and corresponding pairs or outlet receptacles are provided on the opposite side of each of the wall panels 101, 102 and 103 (not shown in the drawing) to allow various electrical equipments to be plugged into the outlets from either side of the panel.

Figure 2:
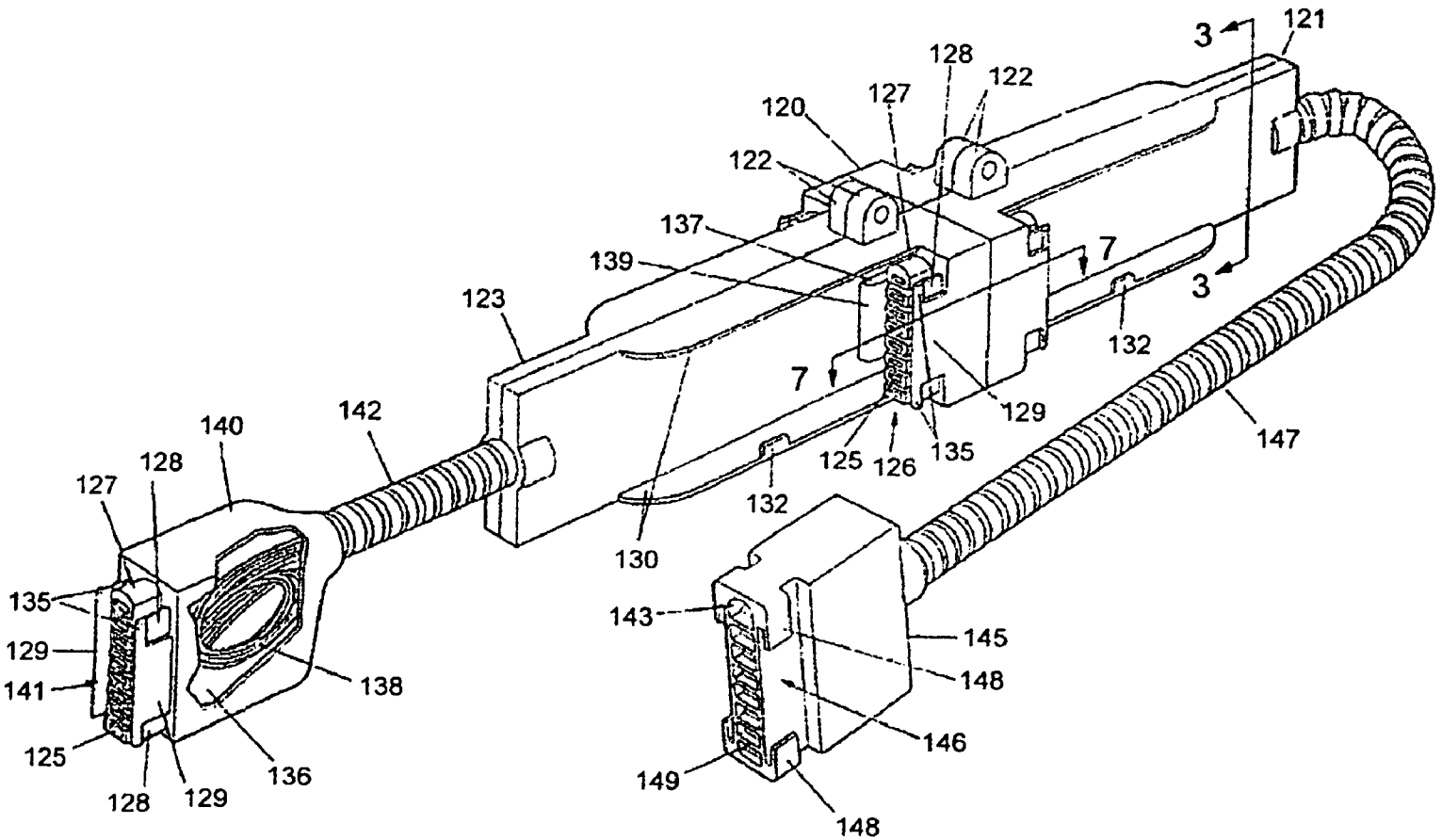
Fig. 2 (Prior Art)
FIG. 2 is a prior art, enlarged perspective view of one of the electrical interconnection assemblies of FIG. 1.

FIG. 2 is an enlarged perspective view of one of the electrical interconnection assemblies, for example assembly 107. The junction block 120 is provided with support lugs 122 by which the junction block is supported by standard fasteners extended through support tables extending from the bottom edge of the wall panel, e.g., wall panel 102. Junction block 120 comprises an elongated housing having opposing ends 121 and 123 and a symmetrical center section comprising four female receptacle connectors 126. Only one of the receptacle connectors 126 is fully exposed in FIG. 2. There is a pair of connectors 126 on each side of the housing and the connection on each side face in opposite directions. Support flanges 130 are provided adjacent each of the female connectors to provide support for electrical outlet receptacles engaged with the connectors 126. In this manner, junction block 120 is adapted to support four electrical outlet receptacles, two on each side of a wall panel to which junction block 120 is attached. The junction block assembly further comprises end connector block 140, provided with a female connector 141, and connected via a standard electrical conduit 142, which may be a flexible conduit, to end 123 of junction block 120. Similarly, connector block 145, provided with a male connector 146 is connected via flexible conduit 147 to end 121 of junction block 120. In a straight line connection arrangement, as depicted for example in FIG. 1, wherein a plurality of panels are positioned adjacent each other, electrical power is transmitted between panels by connection of male connector block 145 to female connector block 140 of the adjacent junction assembly.

Electrical power is transmitted through the junction assembly by means of electrical wires disposed in the conduits 142, 147, terminated on connectors 141 and 146, respectively, and connected to receptacle connectors 126 in junction block 120. Accordingly, electrical power is transmitted through interconnecting panels and is at the same time made available at electrical outlet receptacles in each panel. Conduit 147, provided with the male connector block 145, may be a fixed-length conduit and conduit 142 may be of a length such that female connector block 140 is positioned at substantially the same distance from the panel edge in each panel independent of the width of the panel. Thus, female connector block 140 will always be accessible to male connector block 145 independent of the width of the panels. To accommodate panels of different widths, conduit 142 may be an expandable flexible conduit, such as are well known in the art. In that case, connector block 140 may be provided with an inner spatial area 136, as shown in a partially broken-away view in FIG. 2. The inner spatial area 136 is provided for storage of excess length of electrical wiring 138 in a coiled or other configuration. The excess length of electrical wiring 138 may be withdrawn when conduit 142 is expanded to an extended length. This arrangement is similar to that disclosed in my earlier patent, U.S. Pat. No. 4,579,403 (dated Apr. 1, 1986) and entitled ELECTRICAL JUNCTION ASSEMBLY WITH ADJUSTABLE CONNECTORS.

Figure 4:
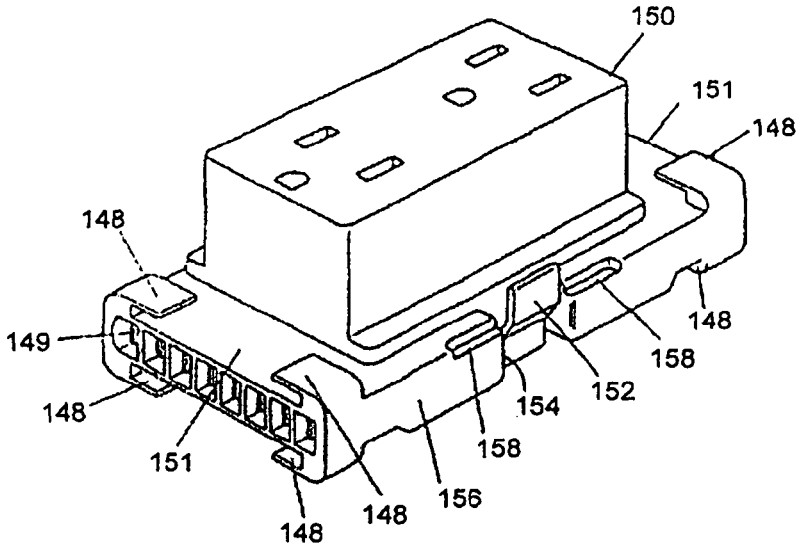
Fig. 4 (Prior Art)
FIG. 4 is a prior art, enlarged perspective view of an outlet receptacle shown in FIG. 1.

The conduit 147 is preferably a flexible conduit which may be bent to accommodate a connection to adjacent panels which are disposed at angular positions with respect to each other, rather than in a straight line. The junction assemblies of this invention readily accommodate an arrangement in which three or more panels are disposed in an intersecting relationship, as will be discussed further herein with respect to FIG. 6. In such a configuration, the male connector block 145 of one of the panels may be connected to one of the female receptacle connectors 126 of a junction block assembly in an adjacent wall panel. For this purpose, the female connector 141 of connector block 140 and female receptacle connectors 126 on junction block 120 have been made identical. Similarly, the male connector 146 on connector block 145 has been made identical to the male connector of electrical outlet receptacle 150, shown in FIG. 1. Greater detail of the receptacle 150 is shown in FIG. 4 and is described below. As may be seen from FIG. 2, the female connectors 126 and 141 are each provided with a pair of side flanges 129 having upper and lower recessed areas 128, for engagement with flanges 148 of a male connector to provide a locking arrangement. FIG. 129, which are made of a resilient plastic material and formed integral to the housing to which they are connected, are provided with an outwardly extending inclined end surface 135. When surfaces 135 are engaged by flanges such as flanges 148 of connector 146 on connector block 145, the flanges 129 will be deflected inward, allowing flanges 148 of the male connector to engage recesses 128 to provide a locking engagement of the male and the female connectors. A protuberance 137 is provided with a generally rounded edge surface 139 and acts as an entry guide as a male connector is engaged in female connector 126. The female connectors 126, 141 are each provided with a plurality of female connector terminals 125 and a key lug 127. Male connector 146 is provided with a plurality of male connector terminals 149 and an opening 143 for receiving key lug 127.

Figure 5:
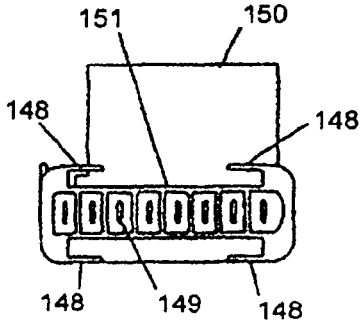
Fig. 5 (Prior Art)
FIG. 5 is a prior art side elevation view of the outlet receptacle of FIG. 4.

The electrical outlet receptacle 150, shown in FIG. 4, is provided with male connectors 151 at both ends, allowing the receptacle to be plugged into any one of the four female receptacle connectors 126 of junction block 120. As shown in FIG. 2, junction block 120 is provided with upper and lower support flanges 130 to support receptacles 150 in each of the four female connectors 126. The lower support flanges 130 are provided with a locking flange 132. The receptacle 150 is provided with a spring latch 152 disposed in recess 154 in the surface 156 of receptacle 150. Surface 156 engages one of the lower support flanges 130 when the receptacle 150 is installed in the junction block 120. The locking flanges 132 will be aligned with the recess 154 when the receptacle 150 is inserted between flanges 130, causing the spring latch 152 to be depressed. The receptacle 150 may then be moved to either the left or to the right to engage one of the female connectors 126. Recesses 158 are provided in receptacle 150 to accommodate locking flange 132 and movement to either the left or to the right by a sufficient distance will cause the spring latch 152 to be moved past locking flange 132, causing the spring latch 152 to return to its extended position. Hence, receptacle 150 will be retained in a locked position. The receptacle may be removed by depressing spring latch 152 and sliding the receptacle 150 to either left or right to align the locking flange 132 with recess 154. FIG. 5 is a right-hand elevation of receptacle 150 showing a right-hand elevation or receptacle 150 showing right-hand male connector 151.

Figure 3:
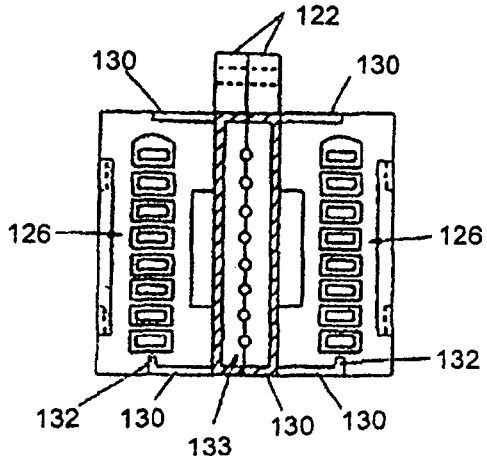
Fig. 3 (Prior Art)
FIG. 3 is a prior art cross-sectional view taken along lines 3-3 of FIG. 2.

FIG. 3 is a cross-sectional view of junction block 120 taken along line 3-3 of FIG. 2. FIG. 3 shows two of the four receptacle connectors 126 of connector block 120. One of the two connectors 126 shown in FIG. 3 is disposed on each side of the central housing section 131, which contains a plurality of wires 133. An eight-wire system is shown in this illustrative embodiment. Each of the male and female connectors are provided with eight separate terminals, and eight separate electrical wires 133 extend through the connector blocks 140, 145, the conduits 142, 147 and the central section 131 of the junction block 120. By way of example, these may include two ground terminal wires, three neutral wires and three positive wires representing three separate circuits, with a shared ground for two of the circuits. Similarly, 10- or 12-wire systems may be readily accommodated, having corresponding number of terminals on each of the connectors and providing a greater number of separate circuits. The four female receptacle connectors 126 are each connected to the wires 133 by means of a plurality of contact blades, described later herein with respect to FIGS. 7 and 8. Each wire, together with the connector block terminals and receptacle connector terminals to which it is connected, is referred to herein as a circuit element. A particular circuit may be selected for use by one of the receptacles 150 by appropriate wiring connections internal to the receptacle. Since all of the circuits are connected to each one of the receptacle connectors 126 of junction block 120, a connector block 145 of an adjacent panel, equipped with a male connector, may be connected to any one of the receptacle connectors 126. In this manner, electrical power may be provided to receptacle connectors to junction block 120 and to associated connector blocks 140, 145 and hence to any adjacent panels to which these connectors may be connected. Similarly, a connector block 145 equipped with a male connector connected to one of the female connectors 126 may receive electrical power for distribution to a panel to which the connector block 145 belongs. Such interconnecting arrangements are described further herein with respect to FIG. 6.

Figure 7:
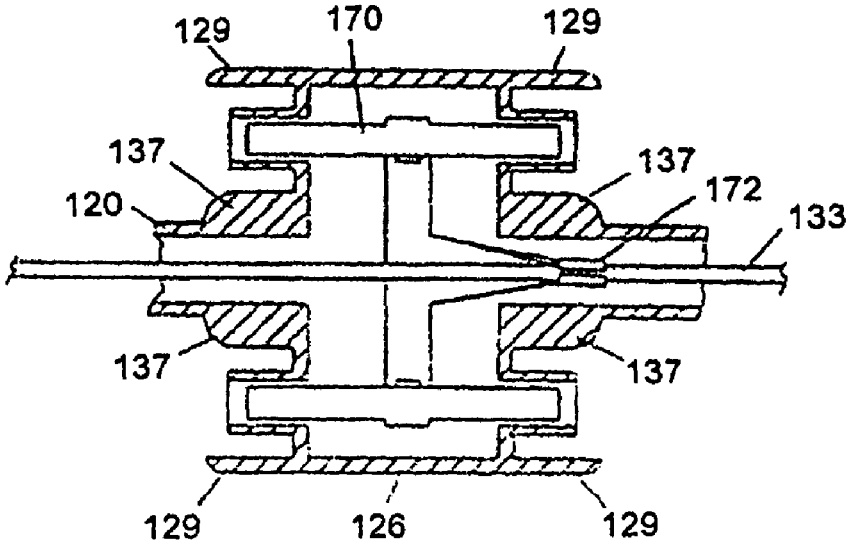
Fig. 7 (Prior Art)
FIG. 7 is a prior art, fragmentary cross-sectional view taken along lines 7-7 of FIG. 2.

FIG. 7 is a fragmentary cross-sectional view along line 7-7 of FIG. 2. Shown in FIG. 7 is a contact blade structure 170 which is one of eight such blades disposed in central housing section 131. Each such blade is in electrical contact with one of the conductors 133. Connection to conductor 133 is made by means of a crimped connection of blade extension member 172 to conductor 133. As may be more readily seen from the perspective view of FIG. 8, the extension member 172 is part of a center section 173 which is connected to left-hand upper and lower contact blades 174 and right-hand upper and lower contact blades 175. The upper and lower contact blades on each side from the female opening part of the conductor 126 for engagement with blades of a male connector.

Figure 6:
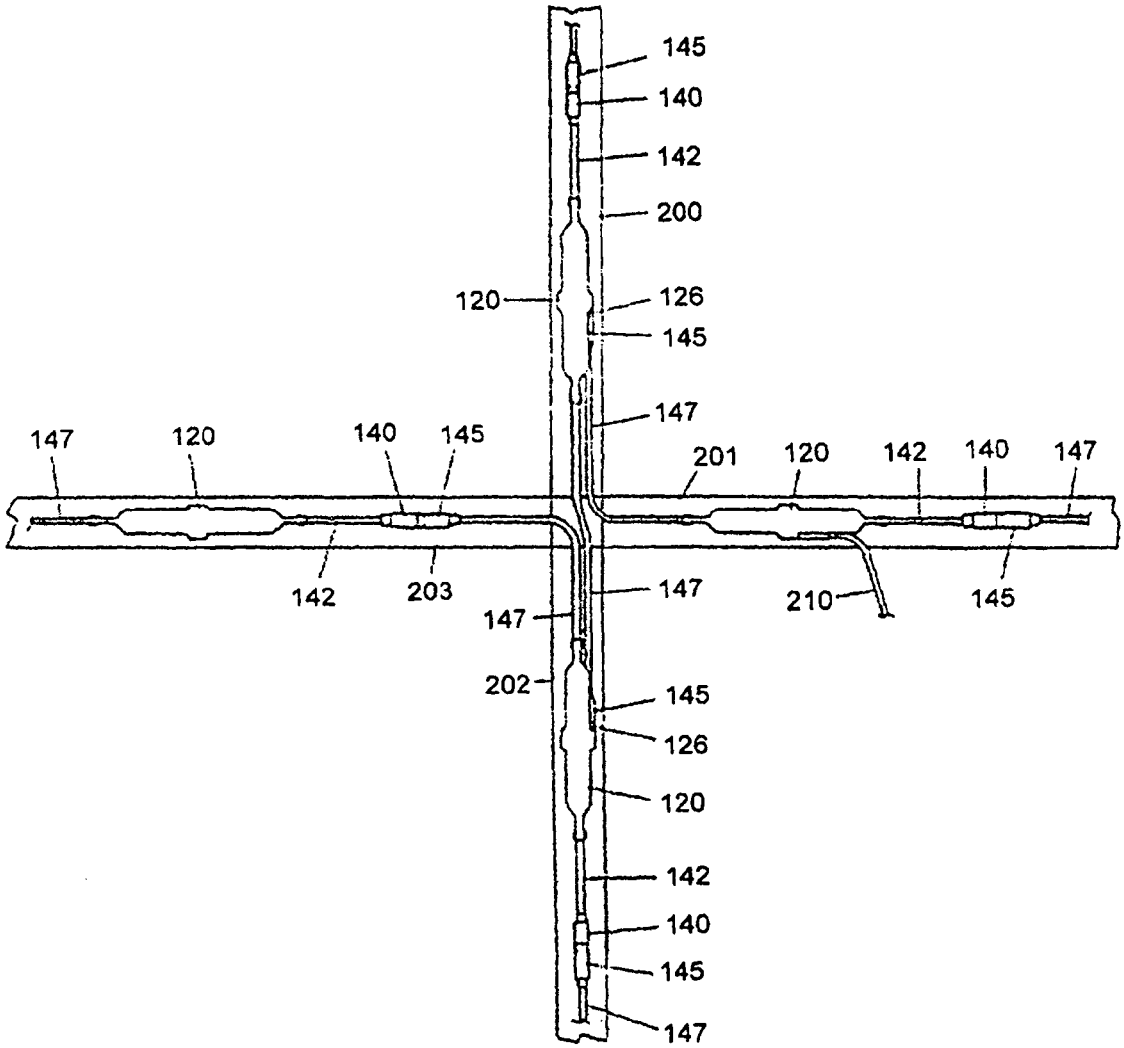
Fig. 6 (Prior Art)
FIG. 6 is a prior art, fragmentary plan view of raceway areas of four wall panels, illustrating wall panel interconnections.

FIG. 6 is a fragmentary plan view of raceway areas of four wall panels illustrating the connections of interconnection assemblies of the invention in a configuration in which the four panels are disposed at right angles to each other. As will be apparent from the following description, the specific angle at which the panels are positioned is not particularly significant. Furthermore, the invention is equally applicable to a three-panel configuration or a five-panel configuration disposed at right angles to each other. Each of the four panels is provided with an interconnection assembly, as shown in FIG. 2, comprising a junction block 120, a male connector block 145, and a female connector block 140 attached to the junction block 120 by means of flexible conduits 147 and 142, respectively. The junction block 120 is disposed within each panel raceway near one edge of the panel. Panels 200, 201, 202 are positioned such that the end at which these panels are joined to other panels is the end near which the junction block 120 is positioned. One of the panels, panel 203, is positioned with an opposite orientation in which the end near which the junction block 120 is located is positioned opposite the point of junction of the four panels. The flexible conduit 147, provided with the male connector block 145, extends beyond the end of the panel in which it is positioned, and the flexible conduit 142, provided with a female connector block 140, is terminated just short of the end of the panel. Thus, as is also shown in FIG. 1, a connection is made between panels by extending the flexible conduit 147 with male connector block 145 into the raceway area of the adjacent panel to engage the female connector block 140 at the end of flexible conduit 142. In the configuration of FIG. 6, the male connector block 145 of panel 202 and its associated flexible conduit 147 extend into the raceway area of panel 202 to engage female connector block 140 of panel 203. It will be apparent that the connection as shown between panel 202 and 203 may be made whenever these panels are adjacent and independent of the angle at which the panels are disposed with respect to each other. In the configuration of FIG. 6, the flexible conduit 147, with its male connector block 145, associated with the panel 200 are extended into the raceway area of panel 202 for engagement with one of the female receptacle connectors 126 of junction block 120 in panel 202. In this manner, an electrical connection is established among the junction blocks of the three panels 200, 202, and 203. Thus, electrical power provided from an external source to any one of these three may be distributed to the other two by means of the connection arrangement shown by way of example in FIG. 6. In the arrangement of FIG. 6, flexible conduit 147 and its male connector block 145 of panel 202 is connected to one of the female connectors 126 of junction block 120 of panel 200 thereby establishing an electrical connection between panels 200 and 201. This connection, in combination with the other connections shown in FIG. 6 and described in the previous sentences, completes an arrangement for establishing an electrical connection from any one of four panels to the entire four-panel configuration. Additional connections may be envisioned by connections of male connectors 145 from other panels into additional ones of the female receptacle connectors 126 of the junction blocks 120 of any of the panels 201 through 203, should one choose to provide an arrangement of more than four intersecting panels. Furthermore, additional conduits, such as conduit 210 shown in FIG. 6, may be connected by means of a male connector to any of the receptacle connectors 126 to provide electrical power to lamps or other fixtures. As can be seen, a great deal of flexibility has been achieved by the electrical junction assembly in accordance with this invention.

Figure 9:
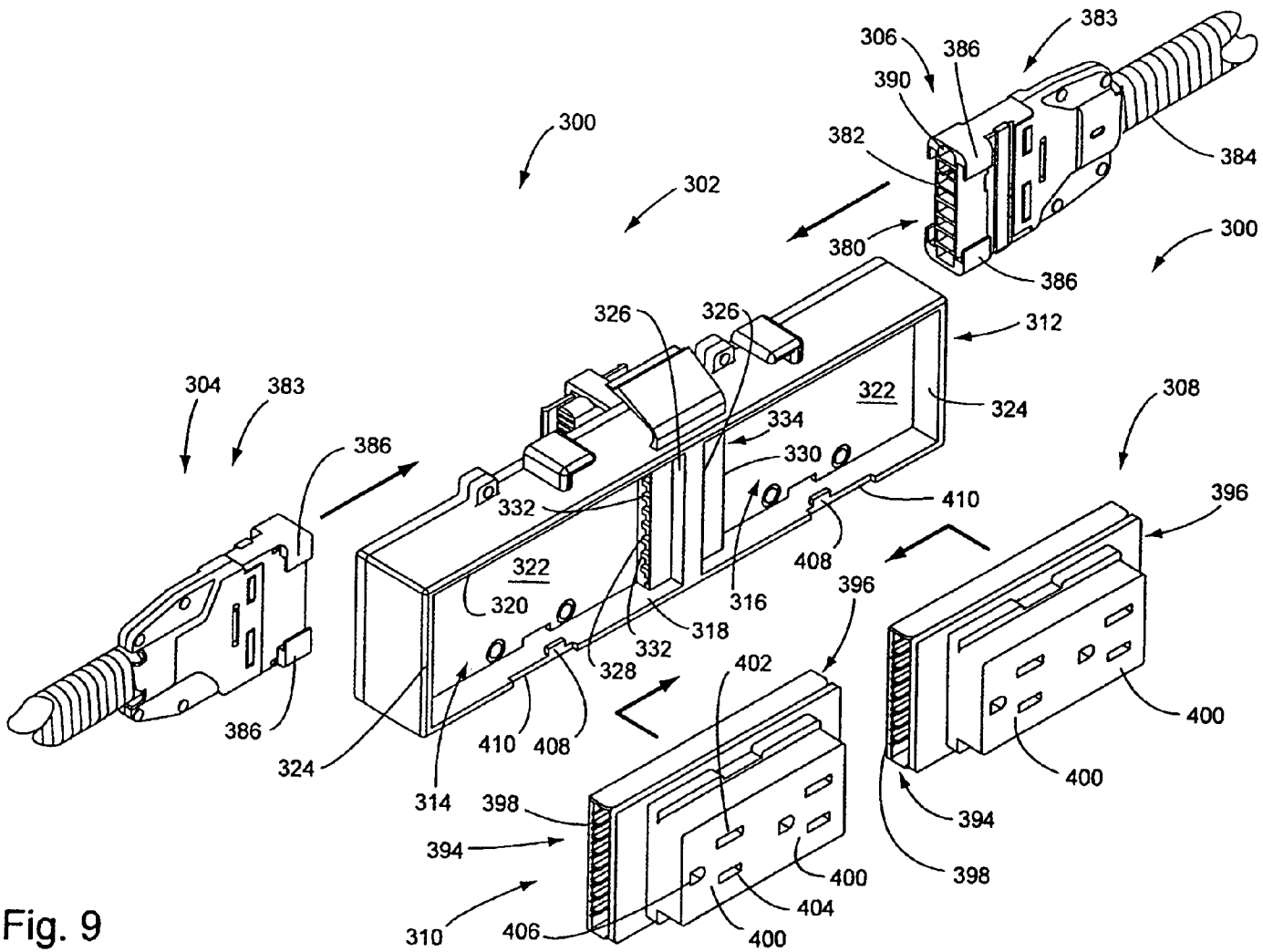
FIG. 9 is a perspective and partially exploded view of a center connect single-sided junction block assembly in accordance with the invention.

The foregoing description was a disclosure of an example prior art system, adapted for use in wall panels of a space divider system. Turning to the specific embodiment in accordance with the invention, the junction block assembly 300 is illustrated in FIGS. 9-14. Turning to FIG. 9, the junction block assembly 300 includes a junction block 302. The junction block 302 is characterized as being "single-sided" in that it provides for interconnection of receptacle blocks only on one side of the junction block 302. As further shown in FIG. 9, the junction block assembly 300 includes a first center connect cable assembly 304 and a second center connect cable assembly 306. The cable assemblies 304, 306 may be identical. As described in greater detail in subsequent paragraphs herein, the first and second center connect cable assemblies 304, 306 are adapted to electrically interconnect to the junction block 302, in a manner so that electrical power received from one of the cable assemblies 304, 306 may be applied to electrical receptacle blocks connected to the junction block 302 and so as to apply power to the other of the center connect cable assemblies 304, 306. As further illustrated in FIG. 9, the junction block assembly 300 includes a first electrical receptacle block 308 and a second electrical receptacle block 310. Each of the receptacle blocks 308, 310 is adapted to be releasably interconnected to the junction block 302 and, correspondingly, to the cable assemblies 304, 306 so that electrical power can be supplied to receptacles associated with the receptacle blocks 308, 310.

Turning specifically to the junction block 302, the block 302 will now be described with respect to FIGS. 9-14. FIG. 13 illustrates a pair of junction blocks 302, and specifically illustrates a side of one of the junction blocks 302 which opposes the side of the junction block 302 viewable in FIG. 9. More specifically, the junction block 302 comprises a housing 312. The housing 312 includes a pair of recessed or spatial areas 314 and 316, referred to herein as the first recessed area 314 and second recessed area 316. As will be described in subsequent paragraphs herein, the recessed areas 314, 316 are adapted to received, mechanically and electrically, the electrical receptacle blocks 310, 308. Each of the first and second recessed areas 314, 316 is formed by a lower wall 318 and an upper wall 320. Located at the back of each of the recessed areas 314, 316 is a back wall 322. Each of these spatial areas 314, 316 is also formed by an outer side wall 324 and an inner side wall 326.

Figure 10:
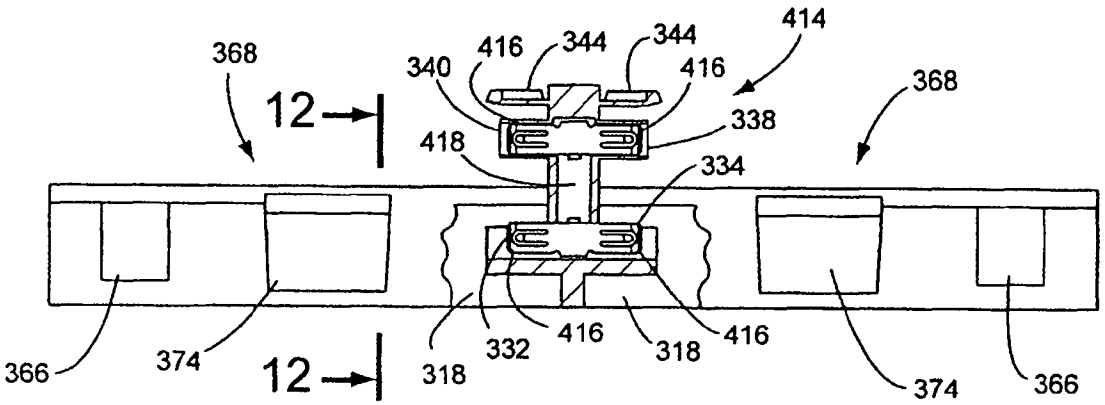
FIG. 10 is a plan view, with a partially cutout portion of the single-sided junction block shown in FIG. 9.

Within the first recessed area 314, a first electrical connector set 328 extends laterally from the inner side wall 326. Correspondingly, an identical second connector set 330 extends laterally outwardly from the inner side wall 326 associated with the second recessed area 316. Each of these connector sets 328, 330 is formed by a series of female connectors 332. The female connectors 332 are formed from individual contact blade structures, somewhat corresponding to the contact blade structure 170 previously described herein with respect to the prior art configurations shown in FIGS. 7 and 8. In the particular configuration illustrated in FIGS. 9-14, each of the connector sets 328, 330 comprises an 8-wire or 8-connector system. That is, eight separate wires 332 are provided. By way of example, these may include two ground terminal connectors, three neutral connectors and three positive connectors representing three separate circuits incoming to the junction block assembly 300. Similarly, 5, 10 or 12-connector systems may be readily accommodated, having corresponding numbers of terminals on each of the connectors and providing for a different number of separate circuits. In addition to the female connectors 332 shown with respect to the first recessed area 314, a further set of female connectors 334 would be associated with the second connector set 330 within the second recessed area 316. An illustration of one of the female connectors 332 and one of the female connectors 334 is shown in FIG. 10.

At the back of the junction block 302 is a pair of center positioned connector sets 336. These connector sets 336 are somewhat similar to the receptacle connectors 126 associated with the prior art system previously described herein. The center position connector sets 336 are referred to herein as a first center position connector set 338 and a second center position connector set 340. Each of these center position connector sets 338, 340 include a set of eight female connectors 342. Each of the center position connector sets 338, 340 is positioned in a straight line relationship relative to the other of the connector sets 338, 340. Referring specifically to FIG. 13, where the first center positioned connector set 338 is shown in relative detail with respect to a second junction block 302, the first center position connector set 338 includes a side flange 344 extending to the side of the female connectors 342. The side flange 344 is provided with upper and lower recessed areas 346. The upper and lower recessed areas 346 are adapted to assist in providing engagement with flanges with one of the first or second center connected cable assemblies 304, 306, respectively. The side flanges 344 are preferably made of a resilient plastic material and formed integral with the housing of the junction block 302 to which they are associated. Preferably, the side flanges 344 are also provided with an outwardly extending inclined end surface 348. When the surfaces 348 are engaged by flanges associated with the cable assemblies 304, 306, the side flanges 344 will be deflected inwardly, allowing flanges of the cable assemblies 304, 306 to engage the recessed areas 346, so as to provide a locking engagement of a center position connector set 366 with a center connect cable assembly 304 or 306.

Each of the junction blocks 302 of the junction block assembly 300 also includes means for releasably coupling the junction block assembly 300 to other structures, including, for example, an upper wall of a raceway within a wall panel or the like. In this regard, reference is made primarily to FIG. 13, illustrating a pair of the junction blocks 302 with a support bracket 350 having the shape and configuration specifically illustrated in FIG. 13. The support bracket 350, as illustrated in FIG. 13, comprises an upper section 358 having a substantially horizontal configuration when installed within a wall panel or the like. Integral with and extending from opposing sides of the upper section 358 are a pair of downwardly turned flanges 360. Extending laterally outwardly from the other opposing sides of the upper section 358, and curve downwardly there from are a pair of integral side arms 362. Integral with each of the side arms 362 and extending outwardly from the lower portions thereof are a pair of laterally extending retaining supports 364.

The support bracket 350 is adapted to be connected to the lower portion of a longitudinally extending support bar 352 as illustrated in FIG. 13. Support bar 352 has a substantially rectangular and hollow configuration. It should be emphasized that various other types of support configurations and supporting components can be utilized in place of the support bar 352. The support bar 352 includes a bottom section 354. Through holes 356 extend through the upper section 358 of the support bracket 350. Corresponding through holes (not shown) would also extend through the bottom 354 of the support bar 352. Connecting means, such as screws or the like (not shown) may be received within the through holes 356 and the through holes (not shown) of the support bar 352 for purposes of interconnecting the support bracket 350 to the support bar 352.

Returning to the junction blocks 302, each of the junction blocks 302 include a pair of L-shaped mounting lugs 366 located at the top of the junction block 302 and each equally spaced from the center thereof. For purposes of securing each of the junction blocks 302 to the support bracket 350, the ends of the laterally extending retaining supports 364 can be received within a corresponding one of each of the L-shaped mounting lugs 366. This configuration is specifically illustrated in FIG. 14, with respect to one of the junction blocks 302 and a pair of the mounting lugs 366.

As shown primarily in FIGS. 9 and 13, each of the junction blocks 302 further includes what could be characterized as a latching device 368 positioned on the tops of the junction blocks 302 and center with respect to the longitudinal length of each of the junction blocks 302. With reference to FIGS. 9, 12 and 13, each of the latching devices 368 includes an interlocking latch member 369. The interlocking latch member 369 is provided with an elongated member such as the cantilever beam 372. The cantilever beam 372 is attached to the top of the corresponding junction block 302 by means of a moving hinge 370. The interlocking latching member 369 may be integrally formed on the top of the corresponding junction block 302, and may be constructed of a resilient plastic material, such as polycarbonate which provides a restoring force on the interlocking latch member 369. The cantilever beam 372 includes an upwardly sloping surface 374 which slops upwardly toward the back of the corresponding junction block 302. At the end of the sloping surface 374 is a tab 376. When the support bracket 350 is appropriately mounted in the ends of the retaining supports 364 are received within the L-shaped mounting lugs 366, the cantilever beam 372 moved toward a corresponding downwardly turned flange 360 of the support bracket 350, and the tab 376 engages the flange 360. This configuration is illustrated with respect to one of the junction blocks 302 and one of the latching devices 368 in FIG. 14. When it is desired to disengage a junction block 302 from a support bracket 350, a downwardly projecting force (either by hand, screwdriver or the like) may exerted on the upwardly sloping surface 374, so as to depress the cantilever beam 372. When the cantilever beam 372 is depressed, the tab 376 of the cantilever beam 372 will move below the end of the corresponding downwardly turned flange on the support bracket 350. In this manner, the retaining tab 376 is disengaged from the flange 360. The junction block 302 may then be removed from the L-shaped mounting lugs 366, by pulling the junction block 302 outwardly from the support bracket 350. Specifically, this outward movement of the junction block 302 will cause the mounting lugs 366 to be disengaged from the retaining supports 364 of the support bracket 350. Similarly, the junction block 302 may be installed and releasably interconnected with the support bracket 350 by slidably engaging the L-shaped mounting lugs 366 with the retaining supports 364. This sliding motion will result in engagement of the latching device 368 with the downwardly extending flange 360, thereby causing the tab 376 to be captured by the flange 360. At that point, the restoring force imparted to the latching device 368 due to the resiliency of the interlocking latch member 369 causes engagement of the tab 376 with the flange 360, thereby placing the junction block 302 in a releasably locked position relative to the supporting bracket 350.

Figure 11:
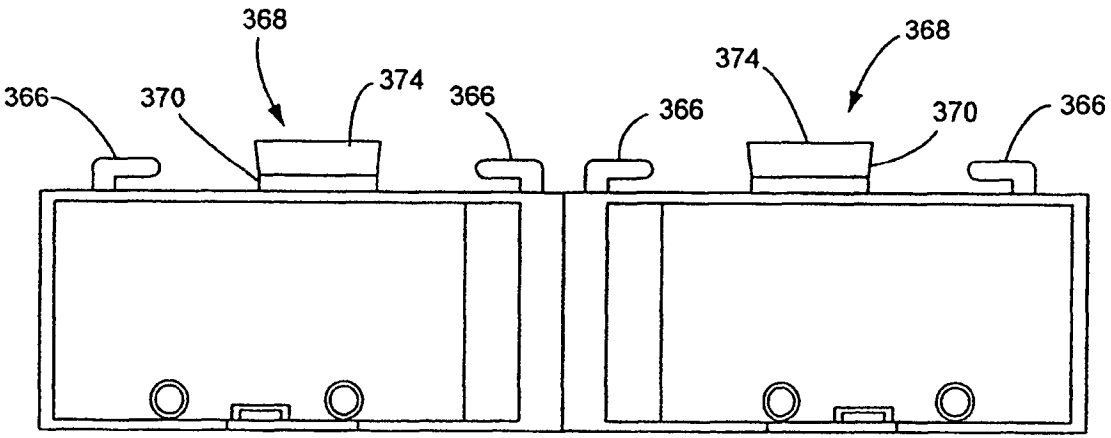
FIG. 11 is a front elevation view of the junction block shown in FIG. 9.
Figure 12:
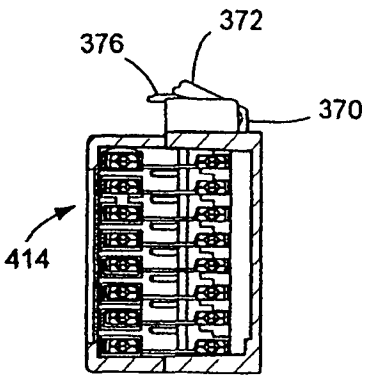
FIG. 12 is a sectional end view of the junction block shown in FIG. 10, taken along section lines of FIG. 10.
Figure 13:
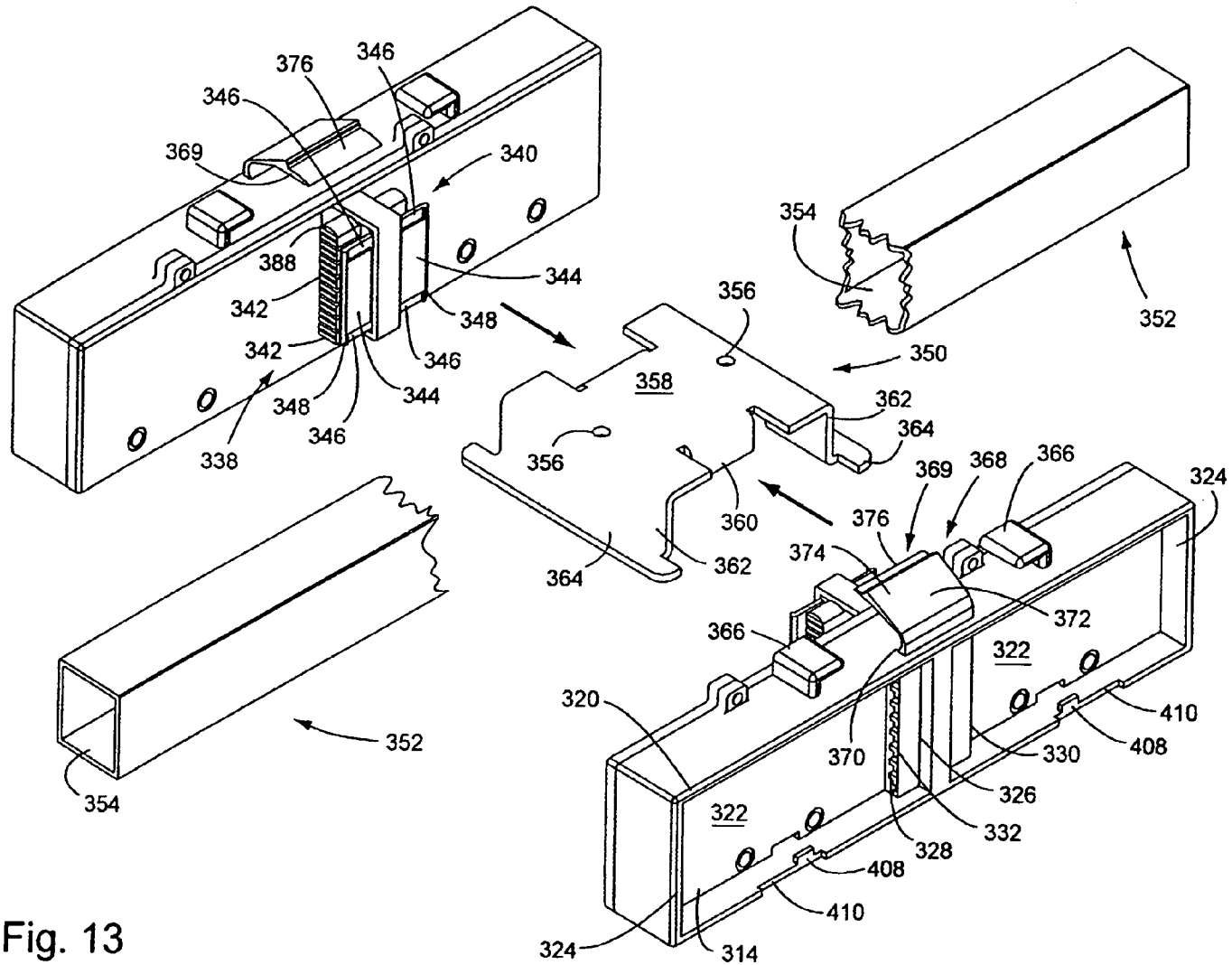
Figure 14:
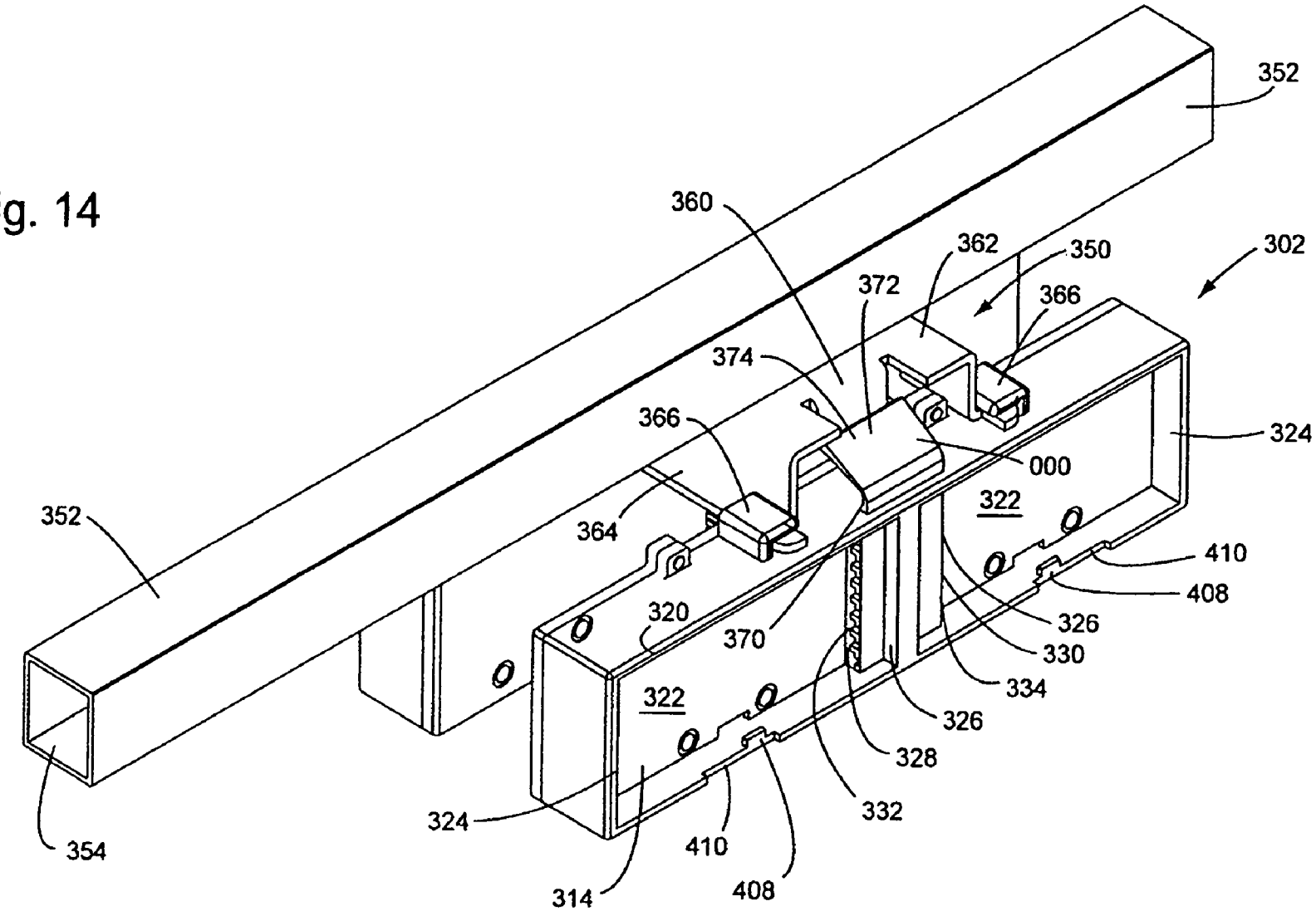
FIG. 14 is a perspective view of the components of the junction block assembly shown in FIG. 13, but shown in a fully assembled state.

A slightly modified embodiment of the junction block 302 illustrated in FIGS. 9 and 13 is shown in FIGS. 10, 11 and 12. Therein, the modified junction block 302 is configured so as to be releasably secured to a pair of support brackets 350 (not shown in FIG. 10, 11 or 12). That is, as specifically shown primarily in FIGS. 10 and 11, the modified junction block 302 includes two pairs of L-shaped mounting lugs 366, with each pair mounted on one side of the top of the junction block 302. Correspondingly, intermediate the mounting lugs 366 of each pair is a latching device 368. Accordingly, the modified junction block 302 includes two latching devices 368. The latching devices 368 and the mounting lugs 366 of the modified junction block 302 shown in FIGS. 10, 11 and 12 operate in exactly the same manner as the mounting lugs 366 and latching device 368 illustrated with respect to the junction blocks 302 illustrated in FIGS. 9 and 13. However, with the configuration shown in FIGS. 10, 11 and 12, one support bracket 350 would be utilized with one latching device 368 and a pair of the mounting lugs 366, while a second support bracket 350 would be utilized with the second latching device 368 and second pair of mounting lugs 366. This configuration could be characterized as providing somewhat greater support for the modified junction block 302, in that two support brackets 350 are utilized to mount the junction block 302 to a support bar 352.

Turning back to the electrical assemblies associated with the junction block assembly 300, the first and second center position connector sets 338, 340, respectively, were previously described herein. For purposes of providing electrical power to the connector sets 338, 340, and for transmitting power through the connector sets 338, 340, the junction block assembly 300 includes a first center connect cable assembly 304 and a second center connect cable assembly 306, as previously referenced herein. Turning primarily to FIG. 9, the first center connect cable assembly 304 is identical to the second center connect cable assembly 306. With respect to each of the cable assemblies 304, 306, each assembly includes a connector block 383 at a terminating end of each of the assemblies 304, 306. Each connector block 383 includes an outwardly extending male connector set 380. Each male connector set 380 includes a series of male connector terminals 382. As previously referenced, the junction block assembly 300 shown in FIG. 9 can be characterized as an "8-wire" assembly. Accordingly, each male connector set 380 would, correspondingly, comprise a set of eight male terminals 382. Electrical power is transmitted to and through the junction block assembly 300 by means of electrical wires (not shown) disposed in an adjustable cable or conduit section 384. The wires (not shown) within the cable or conduit section 384 terminate at the male connector terminals 382 of the corresponding male connector block 383. Although not shown in the drawings, the adjustable cable or conduit section 384 may terminate at its other end in a corresponding male connector block 383 or other electrical assemblies. For example, the other end of either or both adjustable cable or conduit section 384 may terminate in a connector adapted to interconnect directly to cables associated with incoming building supply power or other direct sources of electrical power.

As previously described herein, each of the center positioned connector sets 338, 340 is provided with a side flange 344 having upper and lower recessed areas 346. The upper and lower recessed areas 346 are adapted to assist in providing engagement with flanges 386 of one of the male connector sets 380. In this manner, a releasable locking engagement is provided between a male connector set 380 and a center positioned connector set 338 or 340. As also previously described herein, the side flanges 344 of the center positioned connector sets 338 and 340 are preferably made of a resilient plastic material and formed integral with the housing of the junction block 302 to which they are associated. Preferably, side flanges 344 are also provided with an outwardly extending inclined end surface 348. When the inclined end surfaces 348 are engaged by flanges, such as the flanges 386 of the male connector set 380 on a connector block 383 of a center connect cable assembly 304, 306, the flanges 344 will be deflected inwardly, allowing the flanges 386 of the male connector set 380 to engage the recesses 346, and thereby provide a locking engagement of the center connect cable assembly 304, 306, and a male connector set 380. Preferably, each of the center positioned connector sets 338 and 340 are provided with a key lug 388. Correspondingly, each male connector set 380 is preferably provided with an opening 390 for receiving the corresponding key lug 388. In accordance with the foregoing, the first and second center position connector sets 338, 340, respectively, can be mechanically (in a releasable manner) and electrically interconnected to either of the first center connect cable assembly 304 or the second center connect cable assembly 306.

As earlier described herein, the junction block assembly 300 includes one or more junction blocks 302. Each junction block 302 is adapted to electrically receive a first receptacle block 308 and a second receptacle block 310, as illustrated in FIG. 9. FIG. 9 illustrates prospective views of each of the receptacle blocks 308, 310. In this particular embodiment of receptacle blocks which may be utilized in accordance with the invention, each of the receptacle blocks 308, 310 is provided with a first male connector set 394 extending outwardly from one end of each of the receptacle blocks 308, 310, and an identical second male connector set 396 extending outwardly from an opposing end of each of the receptacle blocks 308, 310. With respect to FIG. 9, the actual terminals of the second male connector set 396 in each of the receptacle blocks 308, 310 is not actually viewable. However, each of the second male connector sets 396 as the exact same configuration as each of the first male connector sets 394. In this regard, providing male connector sets 394, 396 at both ends of the receptacle blocks 308, 310 permits the receptacle blocks 308, 310 to be utilized with a junction block having a configuration such as junction block 302, wherein a first female connector set 328 is located within a first recessed area 314, and a second female connector set 330 is located within the second recessed area 316. That is, with the male connector sets 394, 396 associated with each of the receptacle blocks 308, 310, either of the receptacle blocks 308, 310 can be utilized in either of the recessed areas 314, 316.

As also previously described, the junction block 302 is provided with the open recessed areas 314, 316 in which to support the electrical receptacle blocks 308, 310. In the same regard, each of the first and second male connector sets 394, 396, include a series of male terminals 398. The male terminals 398 comprise blade terminals. Typically, a receptacle block 308 or 310 would comprise three blade terminals, corresponding to a single circuit to be applied from the blade terminals 398 to the electrical receptacles 400 which extend outwardly from the front of each of the receptacle blocks 308, 310. The electrical receptacles 400 illustrated in FIG. 9 comprise three terminal receptacles, and would include a hot, neutral and ground connection. The receptacles 400 are in the form of female terminals, and are adapted to receive conventional, electrical 3-prong plugs (not shown) electrically connected to devices and appliances to be energized. As an example, each of the electrical receptacles 400 may include a hot terminal 402, neutral terminal 404 and ground terminal 406. Each of these terminals of this receptacle 400 is connected to a different one of the blade terminals 398 associated with the connector sets 394, 396.

The bottom portion of each of the receptacle blocks 308, 310 is not illustrated in FIG. 9. However, these bottom portions may have a latching mechanism substantially similar to the latching mechanism previously described herein with respect to the prior art receptacle block 150. That is, with reference to the junction block 302, the recessed area 314 is provided, on its lower wall 318, with a slightly recessed locking flange 408. Correspondingly, the recessed area 316 associated with the junction block 302 also includes on the lower wall 318, a substantially identical locking flange 408. However, as illustrated in FIG. 9, the locking flange 408 associated with the recessed area 314 is positioned to one side of an indentation 410 in the lower wall 318, while the locking flange 408 associated with the recessed area 316 is positioned to an opposing side of an indentation in the lower wall 318 of the recessed area 316.

Although not specifically shown in FIG. 9, but as previously described with respect to the receptacle block 150 associated with the prior art system illustrated in FIGS. 4 and 5, the lower portion of each of the receptacle blocks 308, 310 is provided with a spring latch (not shown) disposed within a recess (not shown) on an underside of each of the receptacle blocks 308, 310. Each of the receptacle blocks 308, 310 can be inserted into the recessed areas 314, 316 of the junction block 302. With the configuration shown in the exploded view of FIG. 9, the first receptacle block 308 can be inserted into the second recessed area 316 so that the electrical receptacles 400 face outwardly from the spatial area 316 illustrated in FIG. 9. When inserted, the locking flange 408 will cause the spring latch (not shown) of the receptacle block 308 to be depressed. The receptacle block 308, with the partial recessed area 316 shown in FIG. 9, may be inserted into the recessed are 316 and then be moved to the left (in the view shown in FIG. 9) so that the male terminals 398 of the first male connector set 394 are electrically engaged with the second connector set 330 having female connectors 334 within the recessed area 316. Further, the receptacle block 308 will also include recesses (not shown) so as to accommodate the locking flange 408. Movement to the left of the receptacle block 308 by a sufficient distance will cause the spring latch (not shown) to be moved passed the locking flange 408, thereby causing the spring latch to return to its extended position. In this manner, the receptacle 308 is physically maintained in a locked but releasable position. The receptacle 308 may be removed from electrical connection with the female receptacle block 330 by depressing the spring latch (not shown) and sliding the receptacle 308 to the right so as to align the locking flange 408 with the recessed area of the receptacle block 308. With this configuration, the receptacle block 308 may be removed from the recessed area 316.

Correspondingly, the receptacle block 310 may be physically moved into engagement within the recessed area 314, and then slid to the right so that the male connector set 396 will electrically engage the female connector set 328 associated with the recessed area 314. the recessed area 314 has a locking flange 410, which functionally corresponds to locking flange 408 previously described with respect to recessed area 316. Also, the receptacle block 310, like the receptacle block 308, will include a spring latch (not shown) disposed within a recess (not shown) in a lower surface of the receptacle block 310. The functional and mechanical operation of engaging and disengaging the receptacle block 310 from the junction block 302 corresponds to the same operations as previously described with respect to receptacle block 308 and the junction block 302. Accordingly, the same will not be repeated herein.

Figure 8:
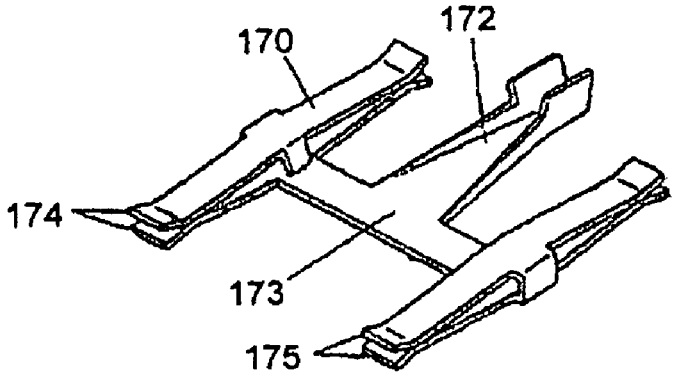
Fig. 8 (Prior Art)
FIG. 8 is a prior art, perspective view of a receptacle contact blade shown in FIG. 7.

As previously described herein, each of the junction blocks 302 includes a first center position connector set 338 and a second center positioned connector set 340. These connector sets are primarily shown in FIG. 13. As also previously described, the connector sets 338, 340 are adapted to electrically engage the male connector sets 380 associated with each of the cable assemblies 304, 306. It should be emphasized that a continuous electrical path exists between the female connectors 342 associated with the first center position connector set 338 and the female connectors 342 associated with the second center position connector set 340. Correspondingly, as also previously described, each of the junction blocks 302 includes a first female connector set 328 associated with the recessed area 314, and a second female connector set 330 associated with the recessed area 316. The female connectors 332 associated with the first female connector set 328 are in a continuous electrical path with the corresponding female connectors 334 associated with the second female connector set 330. Still further, there is a continuous electrical path between connectors associated with the first center position connector set 338, second center position connector set 340, first female connector set 328 and second female connector set 330. This configuration can be achieved through the use of what can be characterized as an H-shaped connector used with respect to each of the eight terminals associated with the female connector sets coupled to each of the junction blocks 302. One of the H-terminals is illustrated in substantial part in FIGS. 10 and 12, and is referred to therein as H-connector 414. As apparent with an 8-wire system, eight of the H-connectors 414 would be utilized. A connector somewhat corresponding to the H-connector 414 was previously described herein with respect to the prior art illustrations of FIGS. 7 and 8, and was referred to as a contact blade structure 170. With reference to FIGS. 7 and 8, and further with reference to FIGS. 10 and 12, each of the H-connectors 414 associated with the junction block 302 in accordance with the invention would substantially correspond to one of the contact blade structures 170 illustrated with respect to FIGS. 7 and 8, but with the contact blade structure 170 having the blade extension member 172 removed. In the prior art configuration illustrated in FIGS. 7 and 8, the blade extension member 172 is utilized to connect to a conductor by means of a crimped connection. As illustrated in FIGS. 10 and 12, each of the H-connectors 414 includes a series of four contact blade sets 416 each of the contact blade sets 416 includes upper and lower contact blades as substantially shown as contact blades 174 and 175 in prior art FIG. 8. As shown expressly in FIG. 10, the contact blade sets 416 form an H-shaped configuration. A common conductor 418 extends between all four of the contact blade sets 416, and provides an electrically conducted path there between. Again, it should be emphasized that with an 8-wire system, eight of the H-connectors 414 would be utilized, and would essentially be stacked as illustrated in FIG. 12. As further illustrated in FIG. 10, one arm of each of the H-connectors 414 would correspond to the female terminals associated with the second center position connector set 340. Correspondingly, an opposing arm would correspond to the female connectors of the first center position connector set 338. Still further, and positioned within the recessed area 314, one set of arms of the H-connectors 414 would correspond to the first female connector set 328. Correspondingly, the remaining arm of each of the H-connectors 414 would correspond to a female terminal of the second female connector set 330.

In accordance with all of the foregoing, an assembly of the junction block assembly 300 will now be described, with respect to essentially all of the FIGS. 9-14. In accordance with the prior discussion, a pair of the junction blocks 302 can be mechanically assembled to a support bracket 350 as shown in FIG. 13. As also shown in FIG. 13, the support bracket 350 can then be connected to a support bar 352. The support bar 352 may be an upper portion of a supporting structure for a raceway or the like. If desired, two of the junction blocks 302 can be connected to the support bracket 350, at opposing ends thereof.

After such connection, the first center connect cable assembly 304 can be electrically and mechanically connected to the second center position connector set 340. Correspondingly, the second center connect cable assembly 306 can be mechanically and electrically connected to the first center position connector set 338. With these connections, I am assuming that electrical power is being transferred from either the first center connect cable assembly 304 or the second center connect cable assembly 306, electrical power is thereby supplied to both the first female connector set 328 within the recessed area 314 of junction block 302, and the second female connector set 330 located within the recessed area 316 of the junction blocks 302. As previously described, in the particular embodiment illustrated herein, each of the connector sets 328, 330 may comprise eight female connectors, representing three separate circuits, with each circuit having a hot, neutral and ground connection. Following this assembly, one or more of the first receptacle block 308 and/or second receptacle block 310 may be electrically engaged with the connector sets 328, 330 of the junction block 302. In the particular configuration illustrated in FIG. 9, a second male connector set 396 associated with the second receptacle block 310 would be electrically engaged with the first connector set 328 within the recessed area 314. Correspondingly, the first receptacle block 308, having a first male connector set 394, would be electrically engaged to the second connector set 330 within the recessed area 316 of junction block 302. As also previously described, the first and second male connector sets 394, 396, respectively, would have three "active" male terminals 398 associated with each connector set. These three terminals 398 would be located so that they would electrically engage with one hot, one neutral and one ground connector of either the first connector set 328 or the second connector set 330. In this manner, a selected one of the three available circuits would be provided as electrical power to each of the electrical receptacles 400 associated with the receptacle blocks 308, 310.

With the foregoing configuration, a junction block has been provided with two electrical receptacle blocks, so as to provide a total of four electrical receptacles 400 associated with the junction block 302. Correspondingly, and with primary importance in accordance with the invention, the junction block 302 is adapted so as to provide for a "center connect" of electrical power from center connect cable assemblies 304, 306 to the junction block 302. This center connect type of configuration is particularly useful in certain situations where the junction blocks 302 and the raceways into which the junction blocks 302 may be installed have particular relative sizes and configuration.

It will be apparent to those skilled in the pertinent arts that still other embodiments of center connect junction block assemblies in accordance with the invention can be designed. That is the principles of a center connect junction block assembly in accordance with the invention are not limited to the specific embodiments described herein. For example, various other types of configurations may be utilized for the recessed areas of the junction block, the electrical receptacles and the specific configurations for the incoming and outgoing power cable assemblies. Accordingly, it will be apparent to those skilled in the art that modifications and other variations of the above-described illustrative embodiments of the invention may be effected without departing from the spirit and scope of the novel concepts of the invention.

The invention claimed is:

1. A junction block assembly adapted for use within a raceway of a wall panel for distribution of power through said raceway and through electrical devices external of said raceway, said junction block assembly comprising:

a junction block having a single-sided configuration, in that said junction block provides for interconnection of receptacle blocks only on a first side of said junction block, and does not provide for interconnection of receptacle blocks on a second side of said junction block, said second side opposing said first side;

a first center connect cable assembly adapted to electrically interconnect to said junction block;

a second center connect cable assembly adapted to electrically interconnect to said junction block;

a first electrical receptacle block releasably interconnected to said junction block and electrically interconnected to said cable assemblies;

a second electrical receptacle block releasably interconnected to said junction block and electrically interconnected to said cable assemblies; and said first center connect cable assembly and said second center connect cable assembly are physically and electrically connected to said junction block at positions which are located substantially centrally of the elongated length of said junction block, and also located adjacent said second side of said junction block.

2. A junction block assembly in accordance with claim 1, characterized in that said cable assemblies are adapted to electrically interconnect to said junction block in a manner so that electrical power received from said first center connect cable assembly is applied to said electrical receptacle blocks and to said second center connect cable assembly.

3. A junction block assembly in accordance with claim 1, characterized in that said junction block further comprises:

a housing;

a pair of recessed areas comprising a first recessed area and a second recessed area formed within the housing;

each of said recessed areas being adapted to mechanically and electrically receive said electrical receptacle blocks;

each of said recessed areas is formed by a lower wall, an upper wall, a back wall, an outer side wall and an inner side wall;

within said first recessed area, a first electrical connector set extends laterally from said inner side wall; and within said second recessed area, a second electrical connector set extends laterally from said inner side wall of said second recessed area.

4. A junction block assembly in accordance with claim 3, characterized in that each of said electrical connector sets is formed by a series of female connectors.

5. A junction block assembly in accordance with claim 3, characterized in that each of said electrical connector sets comprises an eight wire system.

6. A junction block assembly in accordance with claim 3, characterized in that said junction block assembly further comprises a pair of center positioned connector sets comprising a first center position connector set and a second center position connector set.

7. A junction block assembly in accordance with claim 6, characterized in that each of said first center position connector set and second position connector set is electrically connected to one another and to said first electrical connector set extending laterally from said inner side wall of said first recessed area, and to said second electrical connector set extending laterally from said inner side wall of said second recessed area.

8. A junction block assembly adapted for use within a raceway of a wall panel for distribution of power through said raceway and through electrical devices external of said raceway, said junction block assembly comprising:

a pair of junction blocks comprising first and second junction blocks, each of said junction blocks having a single-sided configuration, in that each of said junction blocks provides for interconnection of electrical receptacle blocks only on one side of each of said junction blocks;

a first center connect cable assembly adapted to electrically interconnect to said first junction block;

a second center connect cable assembly adapted to electrically interconnect to said second junction block;

a first electrical receptacle block releasably interconnected to said first junction block and electrically interconnected to said first cable assembly;

a second electrical receptacle block releasably interconnected to said second junction block and electrically interconnected to said second cable assembly; and said first center connect cable assembly and said second center connect cable assembly are physically and electrically connected to said first junction block and to said second junction block, respectively, at positions which are located substantially centrally of the elongated lengths of said junction blocks;

positioned at the back of said first junction block is a pair of first center positioned electrical connector sets;

positioned at the back of said second junction block is a pair of second center positioned electrical connector sets;

each connector set of said pair of first center positioned connector sets includes a side flange extending to a side of connectors of said center positioned connector sets, with said side flange being provided with upper and lower recessed areas adapted to assist in providing engagement with flanges of said first center connect cable assembly; and said side flanges are also provided with outwardly extending inclined end surfaces, with said side flanges being deflected inwardly when said end surfaces are engaged by flanges associated with said cable assemblies, thereby providing a locking engagement of the corresponding one of said center positioned connector sets and said center connect cable assemblies.

9. A junction block assembly adapted for use within a raceway of a wall panel for distribution of power through said raceway and through electrical devices external of said raceway, said junction block assembly comprising:

a pair of junction blocks comprising first and second junction blocks, each of said junction blocks having a single-sided configuration, in that each of said junction blocks provides for interconnection of electrical receptacle blocks only on one side of each of said junction blocks;

a first center connect cable assembly adapted to electrically interconnect to said first junction block;

a second center connect cable assembly adapted to electrically interconnect to said second junction block;

a first electrical receptacle block releasably interconnected to said first junction block and electrically interconnected to said first cable assembly;

a second electrical receptacle block releasably interconnected to said second junction block and electrically interconnected to said second cable assembly;

said first center connect cable assembly and said second center connect cable assembly are physically and electrically connected to said first junction block and to said second junction block, respectively, at positions which are located substantially centrally of the elongated lengths of said junction blocks; and each of said junction blocks further comprises means for releasably coupling said junction block assembly to an upper wall of said raceway.

* * * * *